US007774898B2

(12) United States Patent
Hong et al.

(10) Patent No.: US 7,774,898 B2
(45) Date of Patent: Aug. 17, 2010

(54) VACUUM CLEANER AND METHOD FOR REDUCING NOISE GENERATED THEREBY

(75) Inventors: Seung Gee Hong, Suwon-Si (KR); Jae Man Joo, Suwon-Si (KR); Jun Hwa Lee, Anyang-Si (KR); Tae Seok Yoon, Ahnyang-Si (KR)

(73) Assignee: Samsung Electronics Co., Ltd., Suwon (KR)

( * ) Notice: Subject to any disclaimer, the term of this patent is extended or adjusted under 35 U.S.C. 154(b) by 294 days.

(21) Appl. No.: 11/484,703

(22) Filed: Jul. 12, 2006

(65) Prior Publication Data

US 2007/0143952 A1 Jun. 28, 2007

(30) Foreign Application Priority Data

Dec. 27, 2005 (KR) ..... 10-2005-0131050

(51) Int. Cl.
*A47L 5/00* (2006.01)

(52) U.S. Cl. ..... 15/327.7; 15/327.1; 15/326; 15/347

(58) Field of Classification Search ..... 15/326, 15/327.1, 327.7, 347
See application file for complete search history.

(56) References Cited

U.S. PATENT DOCUMENTS

| | | | | |
|---|---|---|---|---|
| 3,866,263 | A * | 2/1975 | Crouser et al. | 15/412 |
| 5,293,664 | A * | 3/1994 | Lim et al. | 15/326 |
| 6,070,289 | A * | 6/2000 | Lee et al. | 15/326 |
| 6,779,228 | B2 * | 8/2004 | Plomteux et al. | 15/326 |
| 6,779,229 | B2 * | 8/2004 | Lee et al. | 15/329 |
| 6,889,403 | B2 * | 5/2005 | Inoue et al. | 15/353 |
| 6,944,909 | B2 * | 9/2005 | Bair et al. | 15/353 |
| 7,425,225 | B2 * | 9/2008 | Genn et al. | 55/418 |
| 2002/0092123 | A1 | 7/2002 | Stephens et al. | |

FOREIGN PATENT DOCUMENTS

| | | |
|---|---|---|
| DE | 90 06 336 | 10/1991 |
| DE | 196 16 156 | 10/1997 |
| EP | 1 797 808 | 6/2007 |
| KR | 10-2005-0069221 | 7/2005 |
| RU | 2 150 226 C1 | 6/2000 |

OTHER PUBLICATIONS

Extended European Search Report issued Aug. 4, 2008 in corresponding European Patent Application No. 06014947.3.
Office Action issued Nov. 21, 2008 in corresponding Chinese Patent Application No. 200610108710.1.
Official Action issued by the Russian Patent Office in Application No. 2006127372 (6 pages); English language translation of Official Action (3 pages).

* cited by examiner

*Primary Examiner*—Joseph J Hail, III
*Assistant Examiner*—Shantese McDonald

(57) ABSTRACT

A vacuum cleaner has a discharge flow path and a discharged-air filter optimally positioned to reduce noise. The vacuum cleaner includes a body, a dust collection unit positioned in the body to filter foreign matter, a blower fan unit including a blower fan and a motor to generate suction force, an air vent through which air drawn into the body is discharged, and a discharge flow path to guide the air discharged through a discharge port of the blower fan unit to the air vent. The discharge flow path comprises a space defined between the dust collection unit and the blower fan unit.

13 Claims, 5 Drawing Sheets

VACUUM CLEANER AND METHOD FOR REDUCING NOISE GENERATED THEREBY

CROSS-REFERENCE TO RELATED APPLICATIONS

This application claims the benefit under 35 U.S.A. §119 of Korean Patent Application No. 10-2005-0131050, filed on Dec. 27, 2005 in the Korean Intellectual Property Office, the disclosure of which is incorporated herein by reference.

BACKGROUND OF THE INVENTION

1. Field of the Invention

The invention relates to a vacuum cleaner and a method for reducing noise generated thereby, and, more particularly, to a vacuum cleaner, which has a discharge flow path and a discharged-air filter optimally positioned to reduce noise.

2. Description of the Related Art

Generally, a vacuum cleaner is an apparatus, which cleans a room in such a manner that foreign matter such as dust and loose debris is drawn in along with air into a body by generating suction force, and removed through a dust collection unit and the like within the body.

Referring to FIG. 1, a conventional vacuum cleaner includes a body 1 defining an outer appearance, a blower fan unit 2 positioned within the body 1 to generate suction force, and a dust collection unit 3 to filter foreign matter from air drawn into the body 1. The vacuum cleaner is operated in such a manner that suction force is generated by the blower fan unit 2 to draw foreign matter such as dust along with air into the body 1, and only the air is discharged to an outside of the body by filtering the foreign matter from the air via dust collection unit 3 positioned in the body 1, thereby cleaning a room.

The blower fan unit 2 of the conventional vacuum cleaner includes a blower fan 2*a* to generate suction force while rotating, and a motor 2*b* to rotate the blower fan 2*a*. The blower fan 2*a* and the motor 2*b* are positioned to have a rotational axis disposed longitudinally in a front and rear direction such that air is drawn in from a front side, and is then discharged to a rear side. After being discharged to the rear side, the air is guided along a discharge flow path 6, passes through a discharged-air filter 5, and is then discharged to the outside of the body 1 via an air vent 4 positioned at a rear upper portion of the body 1.

In such a vacuum cleaner, noise is generated due to various causes. Specifically, noise generated by rotation of the motor 2*b*, noise generated when air passes through the discharged-air filter 5 via the discharge flow path 6, and noise generated by friction between the air flowing at high speed within the discharge flow path 6 and a duct 7 defining the discharge flow path 6 are causes for the majority of the noise generated from the vacuum cleaner.

However, the conventional vacuum cleaner has problems in that, since the length of the discharge flow path 6 from a discharge port 8 of the blower fan unit 2 to the air vent 4 is short, noise generated by rotation of the motor 2*b* is transferred to the outside of the body 1 without being sufficiently reduced, and in that, since the length from the discharged-air filter 5 to the air vent 4 is also short, the noise generated when air passes through the discharged-air filter 5 via the discharge flow path 6 is also transferred to the outside of the body 1 without being sufficiently reduced.

SUMMARY OF THE INVENTION

Accordingly, it is an aspect of the invention to provide a vacuum cleaner, which has a discharge flow path and a discharged-air filter optimally positioned to reduce noise.

Additional aspects and/or advantages of the invention will be set forth in part in the description which follows and, in part, will be apparent from the description, or may be learned by practice of the invention.

The foregoing and other aspects of the invention are achieved by providing a vacuum cleaner, including: a body; a dust collection unit positioned in the body to filter foreign matter; a blower fan unit including a blower fan and a motor to generate suction force; an air vent through which air drawn into the body is discharged; and a discharge flow path to guide the air discharged through a discharge port of the blower fan unit to the air vent, the discharge flow path including a space defined between the dust collection unit and the blower fan unit.

The discharge flow path may be bent a number of times, and include a first flow path defined from the discharge port of the blower fan unit to the space defined between the dust collection unit and the blower fan unit, a second flow path extending from the first flow path and defined in the space between the dust collection unit and the blower fan unit, and a third flow path from the second flow path to the air vent.

The vacuum cleaner may further include a discharged-air filter positioned in the first flow path or in the second flow path to filter the foreign matter in the air discharged through the discharge port of the blower fan unit.

The discharged-air filter may be positioned at a location of the discharge flow path where the discharge flow path has the greatest cross-sectional area.

The discharged-air filter may be positioned at a location of the discharge flow path where the discharge flow path has a greater cross-sectional area than that of the discharge port of the blower fan unit.

The discharge port of the blower fan unit may have a greater area than that of the air vent.

The discharge port of the blower fan unit may have an area of 7,000 $mm^2$ or more, and the air vent may have an area of 7,000 $mm^2$ or less.

The body may have an opening formed in a bottom surface to exchange the discharged-air filter therethrough, and opened and closed by a door.

The door may be hinged at one side to the opening, while being hooked at the other side thereto.

The dust collection unit may be a cylindrical cyclone device to separate the foreign matter via centrifugal force.

The second flow path may be formed at both sides centered on the cyclone device.

The discharge flow path may have a noise absorption material attached to an inner portion thereof.

In accordance with another aspect of the invention, a vacuum cleaner includes: a body; a dust collection unit positioned in the body to filter foreign matter; and a blower fan unit including a blower fan and a motor to generate suction force, the dust collection unit and the blower fan unit defining a space therebetween to be used as a discharge flow path through which air drawn into the body is discharged to an outside of the body.

The vacuum cleaner may further include a discharged-air filter positioned in the discharge flow path to filter the foreign matter in the air discharged to the outside of the body.

The discharged-air filter may be positioned at a location of the discharge flow path where the discharge flow path has a greater cross-sectional area than that of a discharge port of the blower fan unit, the discharge port of the blower fan unit having a greater area than that of an air vent through which the air drawn into the body is discharged to the outside of the body.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Reference will now be made in detail to the embodiments of the invention, examples of which are illustrated in the accompanying drawings. The embodiments are described below to explain the invention by referring to the figures.

Figure 1:
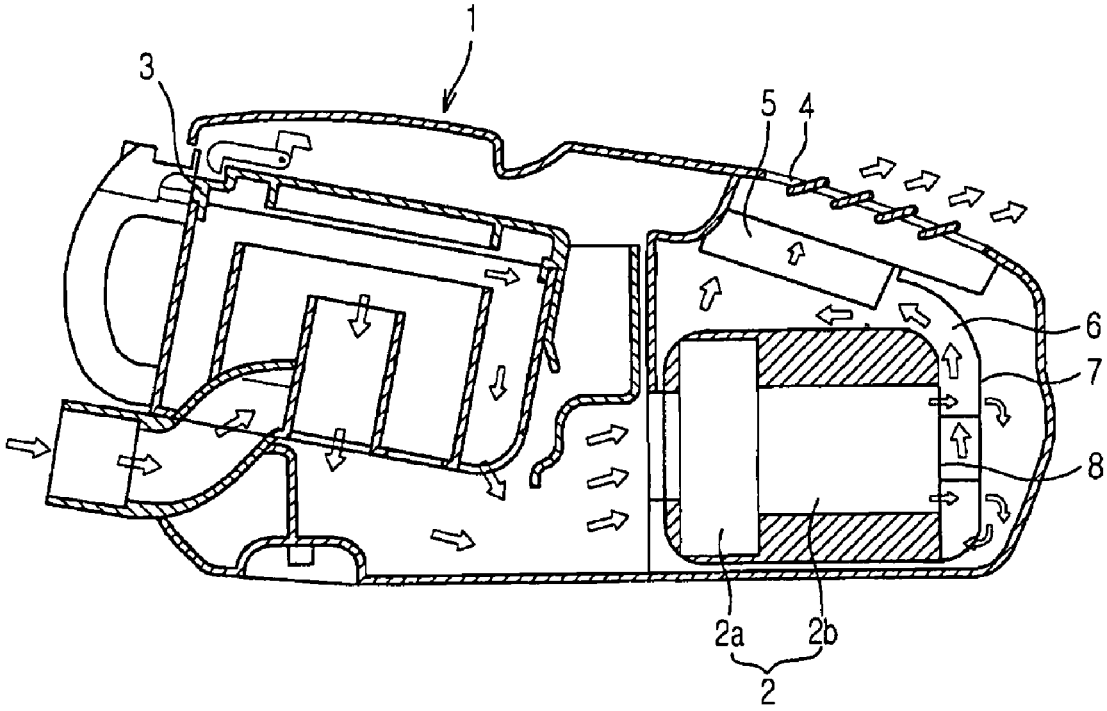
Fig.1 (PRIOR ART)
FIG. 1 is a longitudinal cross-sectional view illustrating a body of a conventional vacuum cleaner.
Figure 2:
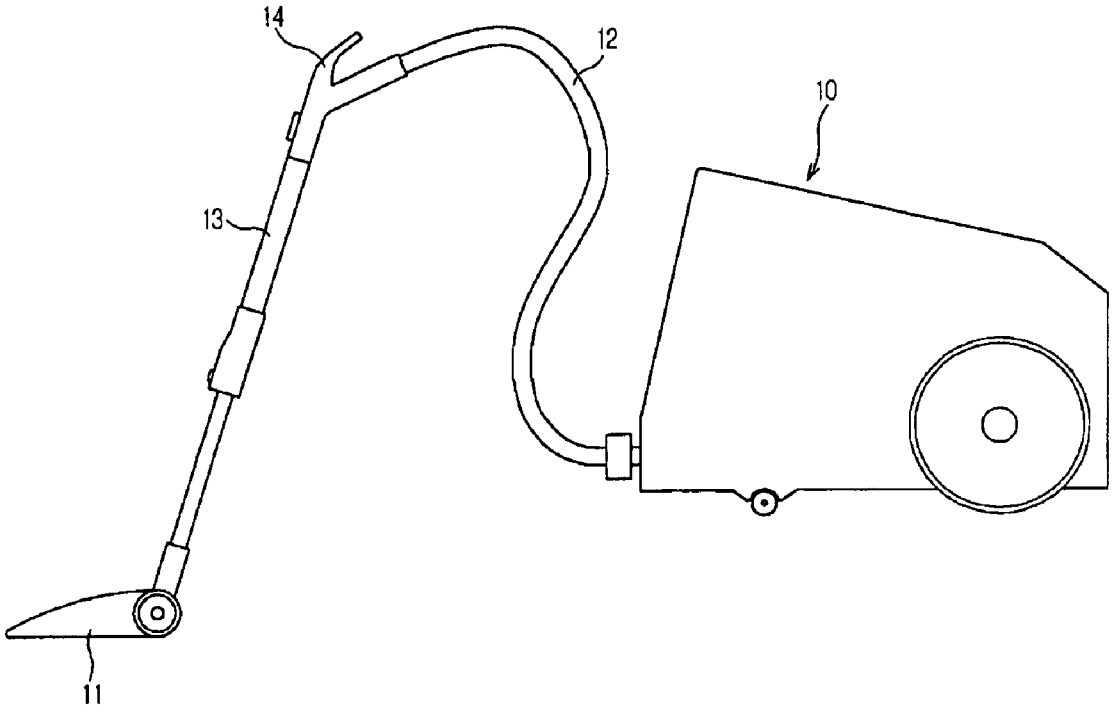
FIG. 2 is a view illustrating an overall configuration of a vacuum cleaner in accordance with a preferred embodiment of the invention.

Referring to FIG. 2, a vacuum cleaner according to a preferred embodiment of the invention includes a suction unit 11 to suck foreign matter together with air via suction force, and a body 10 to collect the foreign matter suctioned by the suction unit 11.

The body 10 and the suction unit 11 are connected via a connection hose 12 and a connection pipe 13 such that the suction force generated from the body 10 is transferred to the suction unit 11 therethrough. The vacuum cleaner is further provided with a handle 14 between the connection hose 12 and the connection pipe 13 so as to be gripped by a user when using the vacuum cleaner.

The connection hose 12 is made of a stretchable corrugated pipe and the like. The connection hose 12 is connected at one end with the body 10, and at the other end with the handle 14 such that the suction unit 11 can be freely moved in a predetermined radius around the body 10. The connection pipe 13 has a predetermined length, and is connected at one end with the suction unit 11 while being connected at the other end with the handle 14 to allow the user to clean the floor using the vacuum cleaner while standing on the floor.

Figure 3:
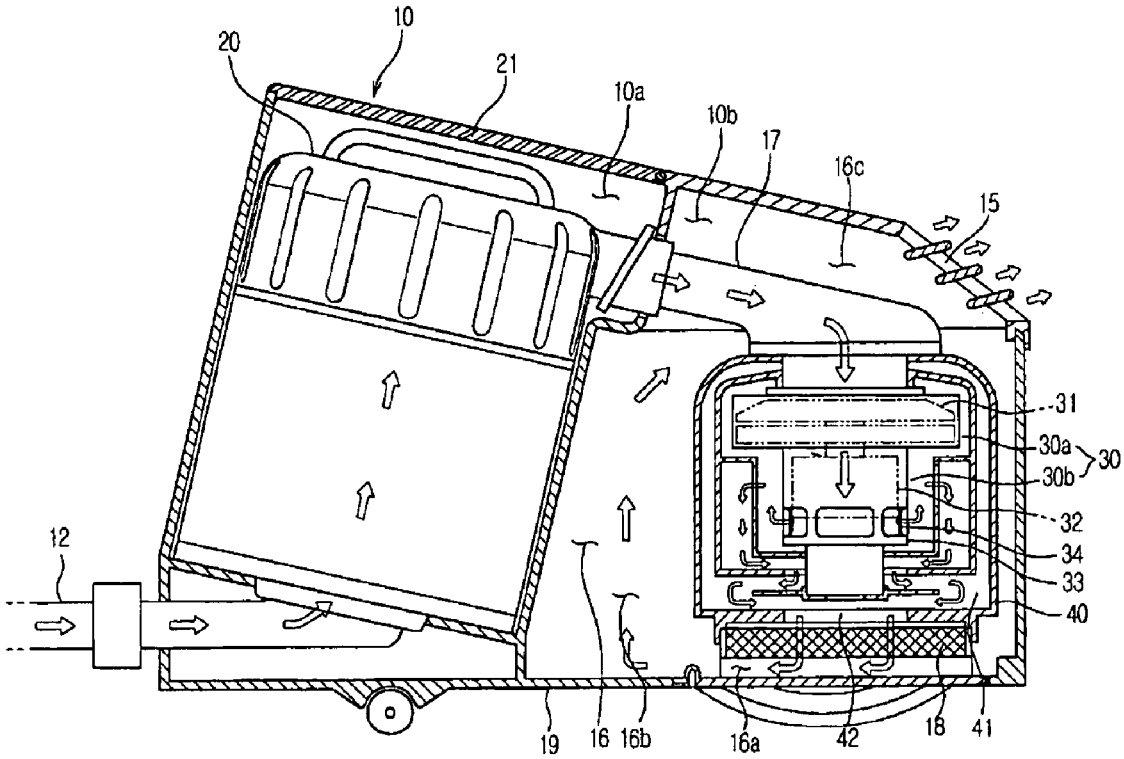
FIG. 3 is a longitudinal cross-sectional view illustrating a body of the vacuum cleaner shown in FIG. 2.
Figure 4:
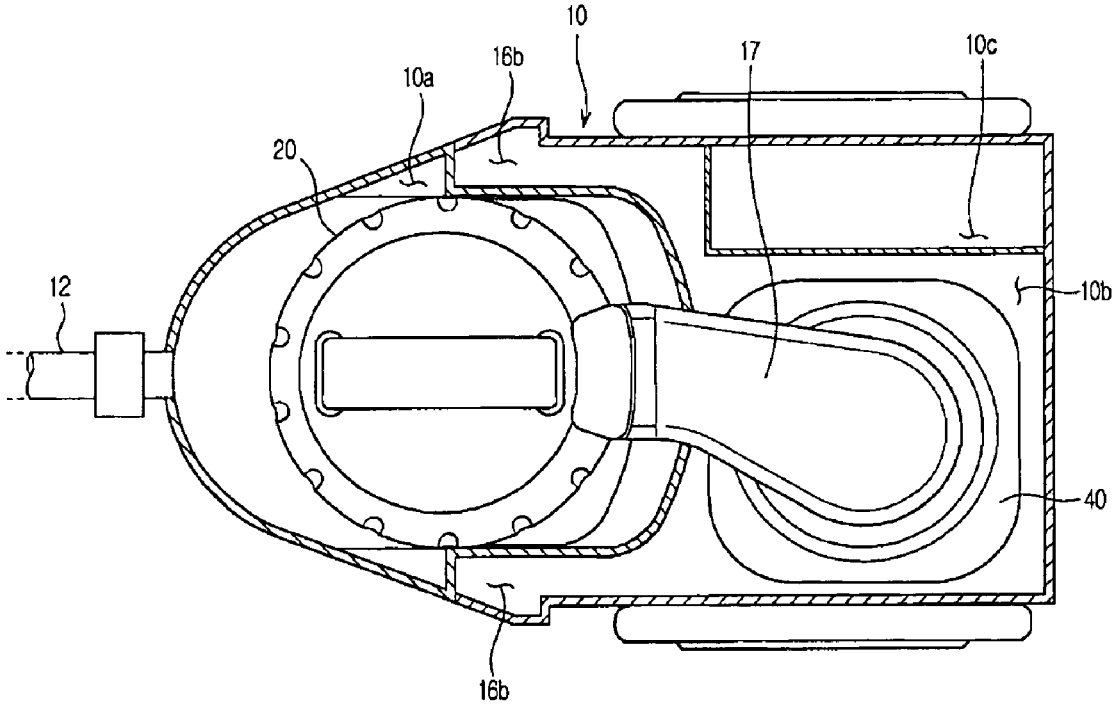
FIG. 4 is a horizontal cross-sectional view illustrating the body of the vacuum cleaner shown in FIG. 2.

In FIGS. 3 and 4, the body 10 is connected at a front side with the connection hose 12 to allow air to flow thereto through the connection hose 12, and is formed at a rear upper portion with an air vent 15 through which, after having the foreign matter removed via a dust collection unit 20 in the body 10, the air is discharged to an outside of the body 10. The body 10 has an interior partitioned into a dust collection compartment 10*a* having the dust collection unit 20 positioned therein, a suction compartment 10*b* having a blower fan unit 30 and a discharge flow path 16 positioned therein, and a power source cord compartment 10*c* having a power source cord (not shown) positioned therein.

The dust collection unit 20 is positioned in the dust collection compartment 10*a* to collect dust drawn into the dust collection compartment 10*a* via the connection hose 12. According to the embodiment, the dust collection unit 20 is implemented by a cyclone device which separates the foreign matter from the air drawn into the dust collection unit 20 using centrifugal force. However, it should be noted that the invention is not limited to the cyclone device, and that any kind of dust bag which can collect dust therein may be used as the dust collection unit. The dust collection compartment 10*a* has a cover 21 hinged to an upper portion of the dust collection compartment 10*a* to allow the dust collection unit 20 to be detachably mounted to the dust collection compartment 10*a*.

The blower fan unit 30 serves to generate suction force in the vacuum cleaner, and is positioned in the suction compartment 10*b* such that a rotational axis of the blower fan unit 30 is disposed up and down therein. The blower fan unit 30 includes a blower fan 31 to generate the suction force, and a motor 32 to rotate the blower fan 31. The blower fan unit 30 has an interior partitioned into a blowing part 30*a* having the blower fan 31 positioned therein, and a driving part 30*b* having the motor 32 positioned therein. A suction side of the blower fan unit 30 is communicated with a discharge side of the dust collection unit 20 via the connection pipe 17 to generate the suction force in the dust collection unit 20.

According to the embodiment, the blower fan 31 of the blower fan unit 30 is constituted by a centrifugal fan which suctions air in an axial direction, and then discharges in a radial direction. With this structure, the air discharged from the blowing fan 31 cools the motor 32 while passing through the driving part 30*b*, and is then discharged in the radial direction through a plurality of discharge outlets 34 formed on an outer periphery of a motor case 33 surrounding the motor 32.

After being discharged through the discharge outlets 34 of the blower fan unit 30, the air flows along an inner flow path 41 defined within a case 40 surrounding the blower fan unit 30, and is discharged through a discharge port 42 formed at a lower portion of the blower fan unit 30. Then, the air is discharged through the air vent 15 via a discharge flow path 16. Here, the discharge flow path 16 refers to a flow path of air from the discharge port 42 of the blower fan unit 30 to the air vent 15. According to the invention, a space defined between the dust collection unit 20 and the blower fan unit 30 constitutes a portion of the discharge flow path 16.

The discharge flow path 16 is bent a number of times, and include a first flow path 16*a* which is defined from the discharge port 42 of the blower fan unit 30 to the space between the dust collection unit 30 and the blower fan unit 20, a second flow path 16*b* which extends from the first flow path 16*a* and is defined in the space between the dust collection unit 30 and the blower fan unit 20, and a third flow path 16*c* from the second flow path 16*b* to the air vent 15.

As such, unlike the conventional vacuum cleaner where the remaining space defined between the dust collection unit 20 and the blower fan unit 30 is a wasted space, the invention utilizes the space defined therebetween as a portion of the discharge flow path 16, and thus secures an enough length of the discharge flow path 16 to enable satisfactory reduction of noise generated from the motor 32 without increasing the size of the body 10.

A discharged-air filter 18 is positioned in the discharge flow path 16 to filter the foreign matter which is not filtered by the dust collection unit 20. Preferably, the discharged-air filter 18 is positioned in the first flow path 16*a* or the second flow path 16*b*.

That is, as the discharged-air filter 18 is positioned in the first flow path 16*a* or the second flow path 16*b*, a sufficient length can be secured from the discharged-air filter 18 to the air vent 15. With this structure, air passes through the discharged-air filter 18 having the sufficient length, and is discharged through the air vent 15, thereby enabling sufficient reduction of noise.

In addition, since the discharged-air filter 18 is positioned in the first flow path 16*a* or the second flow path 16*b* having a relatively larger cross-sectional area, it is possible to secure a sufficient area of the discharged-air filter 18, thereby reducing pressure loss occurring when the air passes through the discharged-air filter 18. In this regard, in order to minimize the pressure loss occurring when the air passes through the discharged-air filter 18 in the discharge flow path 16, it is desirable that the discharged-air filter 18 be positioned at a location of the discharge flow path 16 where the discharge flow path 16 has the largest cross-sectional area.

The first flow path 16*a* or the second flow path 16*b* has a greater cross-sectional area than that of the discharge port 42 of the blower fan unit 30, and the discharge port 42 of the blower fan unit 30 has a greater cross-sectional area than that of the air vent 15. Preferably, the discharge port 42 of the blower fan unit 30 has an area of 7,000 $mm^2$ or more, and the air vent 15 has an area of 7,000 $mm^2$ or less.

In other words, the cross-sectional area of the discharge flow path 16 gradually increases and then decreases from the discharge port 42 of the blower fan unit 30 to the air vent 15. The discharge flow path 16 has a noise absorption material attached to an inner portion thereof to absorb noise. That is, the discharge flow path 16 has the structure, which can expand, resonate, and absorb the noise as in a muffler of a vehicle, and thus significantly reduces the noise generated from the body 10.

Since the dust collection unit 20 is a cylindrical cyclone device, the second flow path 16*b* of the discharge flow path 16 is mainly formed at both sides centered on the dust collection unit 20 as shown in FIG. 4.

Figure 5:
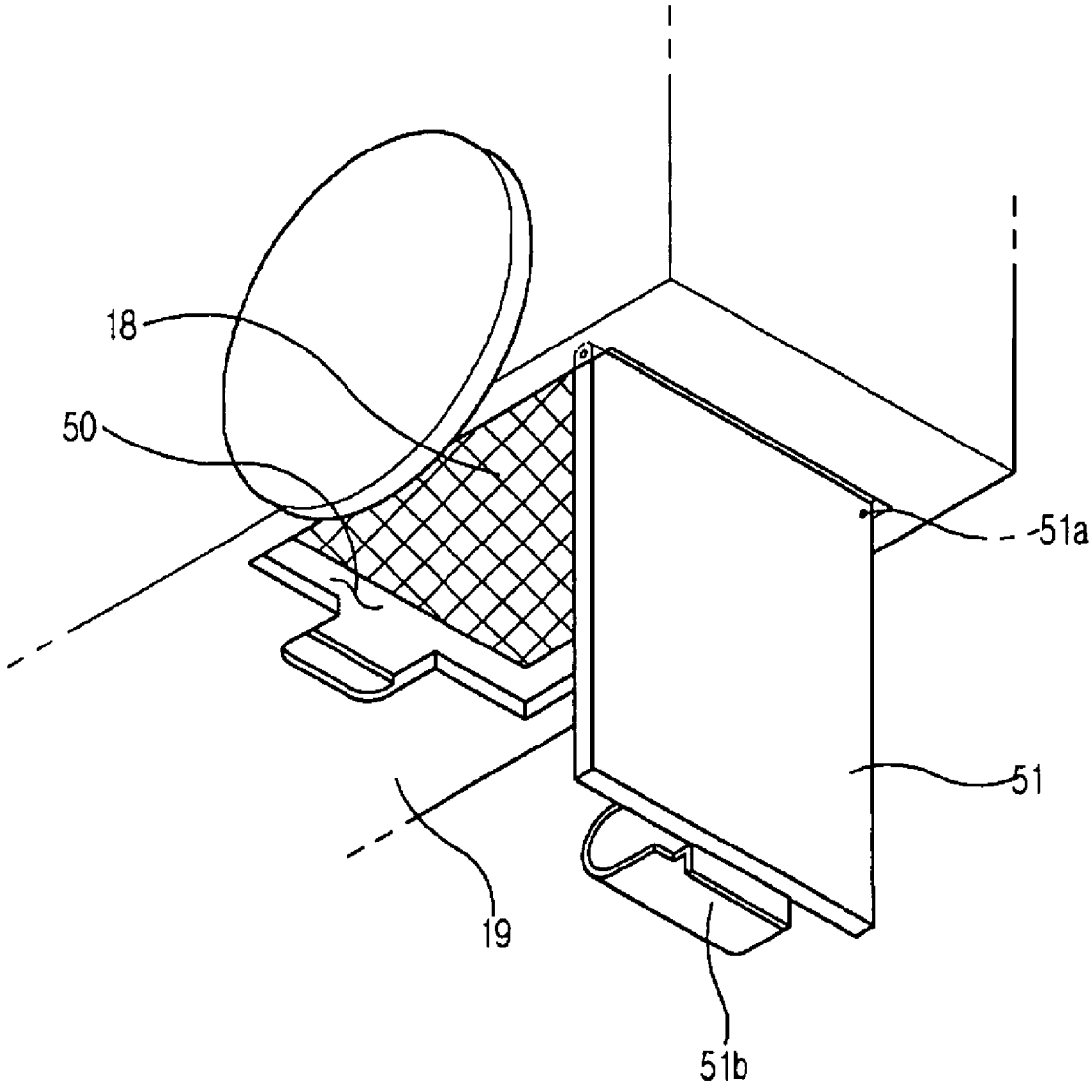
FIG. 5 is a rear view of the body of the vacuum cleaner shown in FIG. 2.

Since the discharged-air filter 18 is mainly positioned in the first flow path 16*a* or the second flow path 16*b*, the body 10 has an opening 50 which is formed in a bottom surface 19 to exchange the discharged-air filter therethrough, and opened and closed by a door 51, as shown in FIG. 5.

In order to allow the door 51 to be easily opened and closed, the door 51 is coupled at one side thereof to the opening 50 by a hinge 51*a*, while being coupled at the other side thereto by a hook 51*b*.

As apparent from the above description, the vacuum cleaner according to the invention has a sufficient length of the discharge flow path so that noise generated from the motor is sufficiently reduced as the air is discharged through the air vent after passing along the discharge flow path.

In addition, the discharged-air filter is separated a predetermined distance from the air vent so that noise generated due to air passing through the discharged-air filter is sufficiently reduced.

Although a few embodiments of the invention have been shown and described, it would be appreciated by those skilled in the art that various modifications, additions and substitutions may be made in these embodiments without departing from the principle and spirit of the invention, the scope of which is defined in the claims and their equivalents.

What is claimed is:

1. A vacuum cleaner, comprising:

a body;

a dust collection unit positioned in the body to filter foreign matter;

a blower fan unit including a blower fan and a motor to generate suction force;

an air vent through which air drawn into the body is discharged; and a discharge flow path to guide the air discharged through a discharge port of the blower fan unit to the air vent, the discharge flow path comprising a space defined between the dust collection unit and the blower fan unit, wherein the discharge flow path is bent a number of times, and comprises:

a first flow path defined from the discharge port of the blower fan unit to the space defined between the dust collection unit and the blower fan unit, a second flow path extending from the first flow path and defined in the space between the dust collection unit and the blower fan unit, a third flow path from the second flow path to the air vent, and a discharged-air filter positioned in the first flow path or in the second flow path to filter the foreign matter in the air discharged through the discharge port of the blower fan unit, and wherein the body has an opening formed in a bottom surface to exchange the discharged-air filter therethrough, and opened and closed by a door.

2. The vacuum cleaner according to claim 1, wherein the discharged-air filter is positioned at a location of the discharge flow path where the discharge flow path has the greatest cross-sectional area.

3. The vacuum cleaner according to claim 1, wherein the discharged-air filter is positioned at a location of the discharge flow path where the discharge flow path has a greater cross-sectional area than that of the discharge port of the blower fan unit.

4. The vacuum cleaner according to claim 3, wherein the discharge port of the blower fan unit has a greater area than that of the air vent.

5. The vacuum cleaner according to claim 4, wherein the discharge port of the blower fan unit has an area of 7,000 $mm^2$ or more, and the air vent has an area of 7,000 $mm^2$ or less.

6. The vacuum cleaner according to claim 1, wherein the door is hinged at one side to the opening, while being hooked at the other side thereto.

7. The vacuum cleaner according to claim 6, wherein the second flow path is formed outside of the cyclone device.

8. The vacuum cleaner according to claim 1, wherein the dust collection unit is a cylindrical cyclone device to separate the foreign matter via centrifugal force.

9. The vacuum cleaner according to claim 1, wherein the discharge flow path has a noise absorption material attached to an inner portion thereof.

10. A vacuum cleaner, comprising:

a body;

a dust collection unit positioned in the body to filter foreign matter;

a blower fan unit including a blower fan and a motor to generate suction force, the dust collection unit and the blower fan unit defining a space between the units to be used as a discharge flow path through which air drawn into the body is discharged to an outside of the body; and a discharged-air filter positioned in the discharge flow path to filter the foreign matter in the air discharged to the outside of the body, wherein the body has an opening formed in a bottom surface to exchange the discharged-air filter therethrough, and is opened and closed by a door.

11. The vacuum cleaner according to claim 10, wherein the discharged-air filter is positioned at a location of the discharge flow path where the discharge flow path has a greater cross-sectional area than that of a discharge port of the blower fan unit, the discharge port of the blower fan unit having a greater area than that of an air vent through which the air drawn into the body is discharged to the outside of the body.

12. A method for reducing noise generated by a vacuum cleaner, comprising:

drawing air containing foreign matter to a dust collection compartment having a dust collection unit positioned therein;

passing and filtering the air from the dust collection unit using a suction compartment having a blower fan unit and a discharge flow path positioned therein, wherein a space between the dust collection unit and the blower fan unit defines the discharge flow path, the blower fan unit includes a blower fan having a blowing part to generate a suction force and motor having a driving part to rotate the blower fan positioned therein, and the discharge flow path is formed by being bent a number of times in the space between the dust collection unit and the blower fan unit without any flow pipes;

generating the suction force to discharge the air from the blowing fan while cooling the motor as the air and foreign matter pass through the driving part;

discharging the air through a plurality of discharge outlets formed on an outer periphery of a motor case surrounding the motor;

passing the air along an inner flow path defined within a case surrounding the blower fan unit;

discharging the air through a discharge port formed at a lower portion of the blower fan unit via the discharge flow path connecting the discharge port of the blower fan unit to an air vent, the discharge flow path comprising passing and filtering the air through a first flow path which is defined from the discharge port of the blower fan unit to the space between the dust collection unit and the blower fan unit, passing and filtering the air through a second flow path extending from the first flow path and formed in the space between the dust collection unit and the blower fan unit, passing and filtering the air through a third flow path from the second flow path, and discharging the air through the air vent; and positioning a discharged-air filter in the in the first flow path or the second flow path of the discharge flow path to filter the air.

13. The method according to claim 12, wherein passing and filtering the air travels through the discharge flow path in a non-linear direction.

* * * * *